US005720229A

United States Patent [19]

Schrage

[11] Patent Number: 5,720,229

[45] **Date of Patent: *Feb. 24, 1998**

[54] RECYCLABLE PLASTIC PALLET

[76] Inventor: David A. Schrage, 27614 Parkview, Apt. 304, Warren, Mich. 48092

[ * ] Notice: The term of this patent shall not extend beyond the expiration date of Pat. No. 5,337,681.

[21] Appl. No.: 335,130

[22] Filed: Nov. 7, 1994

Related U.S. Application Data

[63] Continuation of Ser. No. 919,595, Jul. 24, 1992, Pat. No. 5,365,859.

[51] Int. Cl.[6] ..... B65D 19/38

[52] U.S. Cl. ..... 108/55.5; 206/597; 108/901

[58] Field of Search ..... 108/55.5, 55.3, 108/51.1, 56.1, 56.3, 901, 902; 206/597, 595, 596, 386, 598

[56] References Cited

U.S. PATENT DOCUMENTS

| | | | |
|---|---|---|---|
| 1,944,845 | 1/1934 | Rickwood . | |
| 2,507,588 | 5/1950 | Brandon et al. | 108/55.5 X |
| 2,611,569 | 9/1952 | Coleman et al. . | |
| 2,696,360 | 12/1954 | Toffolon | 108/55.5 X |
| 3,390,765 | 7/1968 | Grant | 108/55.5 X |
| 3,675,595 | 7/1972 | Sullivan | 108/55.5 X |
| 4,270,657 | 6/1981 | Bayon | 108/55.5 X |
| 4,509,432 | 4/1985 | Win . | |
| 4,765,252 | 8/1988 | Shuert . | |
| 4,829,909 | 5/1989 | Mandel . | |
| 4,838,176 | 6/1989 | Bowser, Sr. et al. . | |
| 4,843,976 | 7/1989 | Pigott et al. . | |
| 4,886,694 | 12/1989 | Donnard | 108/55.5 X |
| 5,101,737 | 4/1992 | Gomez | 108/901 X |
| 5,337,681 | 8/1994 | Schrage | 108/56.1 |
| 5,365,858 | 11/1994 | Kuhns | 108/55.5 X |
| 5,365,859 | 11/1994 | Schrage | 108/55.5 X |

FOREIGN PATENT DOCUMENTS

| | | | |
|---|---|---|---|
| 1413646 | 8/1965 | France | 108/55.5 |
| 2241289 | 3/1973 | Germany . | |

*Primary Examiner*—Jose V. Chen
*Attorney, Agent, or Firm*—Brooks & Kushman P.C.

[57] ABSTRACT

Pallets (20) upon which objects (22) may be stacked and to which a wrapping sheet (24) of stretch film, or a strap (102), may be secured to retain the objects (22) in relation to the pallet (20), is disclosed. The pallet (20) has rails (30,32,34) with perpendicularly extending slats (36) secured thereto. The rail (30) has an anchor (66) about which the wrapping sheet (24) may be frictionally and wedgingly retained. The anchor (66) may include either an elongate channel (70,72) or tongue (66) or both. The rails (30,32,34) may have ends with corner supports (60) which cooperate with one another to prevent objects secured atop pallet (20) from moving laterally or longitudinally. Corner supports (60) also allow the pallets (20) to be stacked one on top another. The ends of the rails have grooves (90) formed therein so that the wrapping sheet (24) may be stretchably secured within the groove (90) thereby impeding the wrapping sheet (24) from moving upwardly when wrapped about the pallet (20). The rails (30,32,34) may have stakes (50) formed therein which are received into apertures (54) in slat (36), preferably in a press fit and interlocking manner. Further, the stakes (50) and apertures (54) are heat-staked together to further secure slats (36) to rails (30,32,34). At least one of the rails (30,32,34) or one of the slats (36) may have a plurality of spaced slots (104,124) extending therethrough for cooperatively and releasably retaining strap (102) in a self-locking manner.

16 Claims, 4 Drawing Sheets

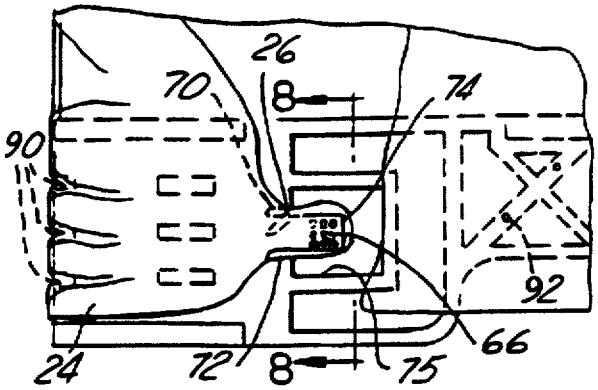
Fig-7
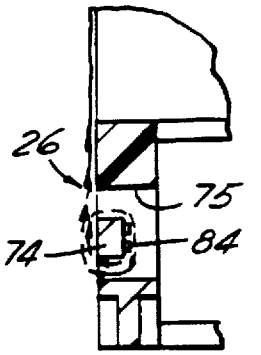
Fig-8
Fig-9
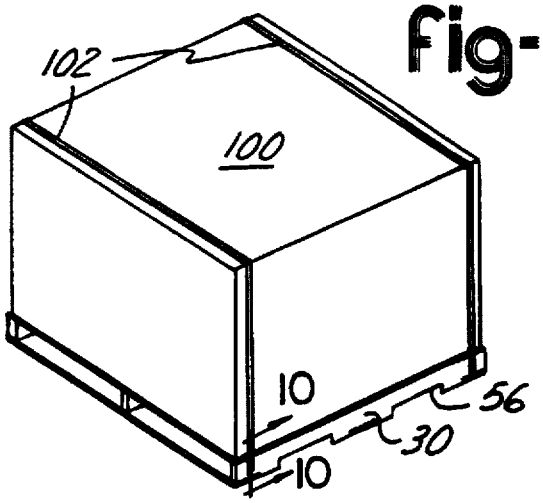
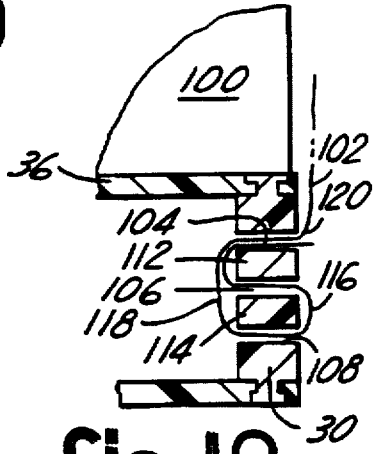
Fig-10
Fig-11
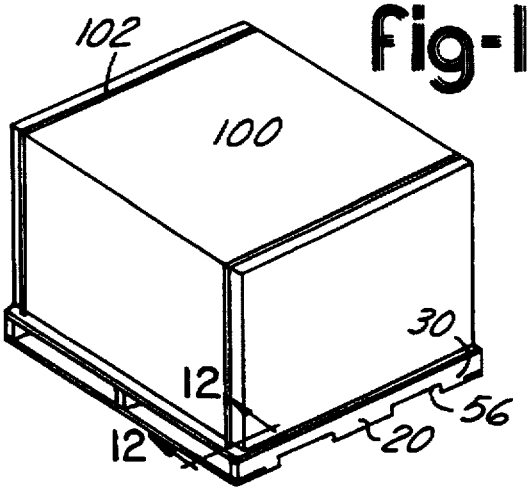
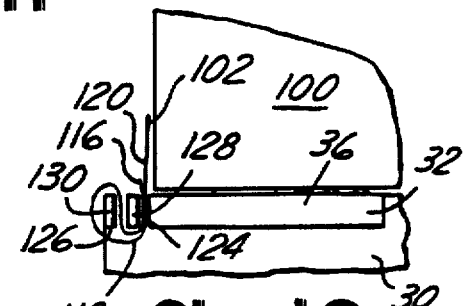
Fig-12

RECYCLABLE PLASTIC PALLET

This is a continuation of application Ser. No. 07/919,595 filed on Jul. 24, 1992 now U.S. Pat. No. 5,365,859.

TECHNICAL FIELD

This invention relates generally to pallets upon which objects or boxes may be stacked, and more particularly, concerns pallets having attachment means for securing straps or wrapping sheets of stretch film.

BACKGROUND ART

Conventionally, pallets are made from wooden boards or planks. The pallets are constructed by spacing apart a plurality of wooden rails and then nailing, perpendicular to the rails, spaced wooden slats to the top and bottom surfaces of the rails. Objects or boxes may then be stacked atop the top surface of the pallet. The pallet, with its load, may then be easily lifted and moved by a fork lift.

A plastic wrapping sheet of stretch film is often used to secure the stacked objects relative to the pallet. A first end of the wrapping sheet is typically tied about the end of a slat adjacent a rail and wrapped in a spiral manner about the pallet and stacked objects, thereby maintaining the stacked objects in relation to the pallet. The wrapping sheet is often 1½ to 3 feet in height and is stretched tightly to cling against the pallet and stacked objects. The free end of the wrapping sheet is simply pressed into clinging frictional engagement against a previous spiral turn of the wrapping sheet to secure the untied end.

Alternatively, the stacked objects or boxes may be banded to the wooden pallet. A band is run around the rails or slats and over the load. The band is then pulled tight and the free ends of the band are clipped to another portion of the band by metal or plastic clips to maintain tension in the band.

These conventional wooden pallets and fastening techniques have numerous shortcomings. First, the pallets are generally not recyclable. Once the useful life of the pallets has been exhausted, the pallets are generally thrown away. If the pallets are not disassembled with their nails being removed and recycled, the nail may rust and become a hazard. The wooden rails and slats are often placed in landfills, thereby adding to the size of already overburdened landfills.

Second, the wooden pallets are unsanitary. The wooden pallets may rot and also serve to host insects and rodents. If the wooden pallets become dirty or contaminated, the wooden pallets are difficult to clean.

Third, the wooden pallets may splinter and cause harm to workers using the wooden pallets. Fourth, the wooden pallets are relative heavy which may result in difficulty in handling, back problems for users, and associated loss of the user's time from work.

Fifth, the wooden pallets are not adapted for compatible use with wrapping sheets of stretch film or with bands. The smooth edges of the wooden pallets do not allow the ends of the wrapping sheets to be quickly and easily attached to the wooden pallets. Rather, the ends of the wrapping sheets must be tied about the wooden pallets. This is time consuming both in terms of attachment and detachment. Also, the spirally wrapped wrapping sheets have a tendency to creep up the sides of the wooden pallets and loosen about a load secured upon the wooden pallet. Further, metal or plastic clips used to fasten the bands, often require separate tools to effect the fastening of the clips to the bands. Finally, the scrapping of the clips also presents disposal problems.

The present invention has been developed to remedy many of the aforementioned shortcomings.

SUMMARY OF THE INVENTION

The present invention includes a pallet upon which objects or boxes may be stacked and to which a wrapping sheet, or a strap, may be secured to retain the objects in relation to the pallet. The pallet comprises longitudinally spaced and laterally extending elongate front and back rails. Preferably, an intermediate rail is longitudinally spaced therebetween. The rails each have vertically spaced top and bottom surfaces. The pallet also has laterally spaced and longitudinally extending elongate slats. The slats are secured to the top and bottom surfaces of the rails.

Preferably, the pallet includes an anchoring means about which the wrapping sheet can be wrapped to quickly retain the wrapping sheet in relation to the pallet. The anchoring means may include channels into which the wrapping sheet is wedgingly or frictionally retained. A laterally extending tongue may be formed between the channels. The tongue may include laterally spaced slots inclined in relation to the laterally extending tongue and may also include a plurality of projections extending therefrom. The channels, the slots and the projections cooperate to wedgingly and frictionally engage and retain the wrapping sheet to the pallet.

The rails may have exterior surfaces including a plurality of projections extending therefrom. The projections should be dimensioned such that the wrapping sheet may be stretchably engaged and retained by the projections.

At least one of the rails has an end with at least one groove formed therein so that the wrapping sheet may be stretchably secured within the groove. The wrapping sheet is thereby impeded from moving upwardly when wrapped about the groove.

The front and back rails may have ends with corner supports including laterally and longitudinally extending flanges extending vertically above the respective top surfaces of the rails. The corner supports cooperate with one another to prevent objects stacked atop the pallet from moving laterally or longitudinally. Further, the corner supports should be dimensioned to cooperate with one another to receive another pallet therebetween, whereby similar pallets may be stackably retained one atop another.

The bottom surfaces of the rails have laterally spaced recesses formed therein which are adapted to receive the forks of a fork lift.

The slats have top surfaces which have vertically extending anti-skid ribs formed thereon to inhibit the sliding of objects upon the top surfaces of the slats. The ribs preferably are orthogonally orientated with respect to one another so as to prevent sliding in the lateral and longitudinal directions.

The slats have apertures formed therein. Also the top and bottom surfaces of the rails have vertically extending stakes. The stakes are dimensioned to be cooperatively received within the apertures of the slats to retain the slats to the rails. The stakes and apertures preferably are joined in a press-fit manner. The stakes preferably have enlarged heads over which the apertures are pressed to retain the slats to the rails. Ideally, the stakes and the apertures are heat-staked together as well.

The rails may have spaced notches which receive associated slats so that the top surfaces of the rails and the top surfaces of the slats cooperate to form a flush, planar top surface on the pallet. The lateral edges of the slats may have laterally outwardly extending flanges and the notches may have undercuts, the flanges and undercuts being press-fit together to form an interlocking joint.

At least one of the rails may have a plurality of vertically spaced slots extending therethrough for cooperatively and releasably retaining a strap in a self-locking manner. Similarly, at least one of the slats may have a plurality of laterally spaced slots formed therethrough for cooperatively and releasably retaining the strap in a self-locking manner.

The pallets have indicia formed therein which are representative of the material from which the pallet is made or else indicative of the size of pallet. For example, the pallets may be different colors to represent different sizes of pallets.

A pallet, made in accordance with the present invention, may include any one or a combination of the aforementioned features.

The present invention also includes a method of making a pallet for retaining objects atop thereof. The method comprises the following steps. First, a thermoplastic material is provided. Elongate rails and elongate slats are then molded from the thermoplastic material. Connections are formed between the slats and the rails to form a generally rectangular pallet. Ideally, the slats and rails are press-fit together to form mechanically interlocking or interfitting joints. The method may further include forming any of the features described above with respect to the pallet made in accordance with this invention.

It is an object of the present invention to provide a pallet which is made from recycled plastic.

It is another object to provide the pallet having an anchoring means about which a wrapping sheet of stretch film may be quickly attached and detached.

An additional object is to provide a pallet having rails with ends possessing at least one groove formed therein so that the wrapping sheet may be stretchably secured within the groove, thereby keeping the wrapping sheet from moving upwardly when wrapped about the pallet.

Still yet another object is to provide pallets having corner supports which cooperate with one another to prevent objects stacked on top of the pallets from moving laterally or longitudinally, and further, to allow pallets to be stackably retained one atop another.

Another object is to provide a pallet having a plurality of projections extending from exterior surfaces on the pallet such that a wrapping sheet wrapped about the pallet may stretchably engage the projections thereby preventing the wrapping sheet from moving relative to the pallet.

A further object is to provide a pallet with rails having vertically extending stakes and slats having apertures, wherein the stakes are cooperatively received within the apertures to retain the slats to the rails thereby forming the pallet. Preferably, the slats and rails are press-fit together to form interlocking or interfitting joints.

Still yet another object is to provide a pallet wherein at least one of the rails or one of the slats has a plurality of spaced slots formed therethrough for cooperatively and releasably retaining a strap in a self-locking manner.

Other objects, features and advantages will become more readily apparent from the following description and accompanying sheet of drawings.

BRIEF DESCRIPTION OF THE DRAWINGS

FIG. 7 is a fragmentary front view showing a wrapping sheet wrapping about an anchoring means and being stretchably retained in grooves in the end of a rail of the pallet;

FIG. 8 is a sectional view taken along line 8—8 of FIG. 7;

FIG. 9 shows a large box on top of the pallet which is secured by a pair of longitudinally extending straps;

FIG. 10 is an enlarged fragmentary view taken along line 10—10 of FIG. 9 showing one of the straps self-locking about slots in a rail of the pallet;

FIG. 11 is a perspective view of the box atop the pallet being retained by a pair of laterally extending straps;

FIG. 12 is sectional view taken along line 12—12 of FIG. 11 showing one of the straps self-locking about slots in a slat of the pallet;

BEST MODE FOR CARRYING OUT THE INVENTION

Figure 1:
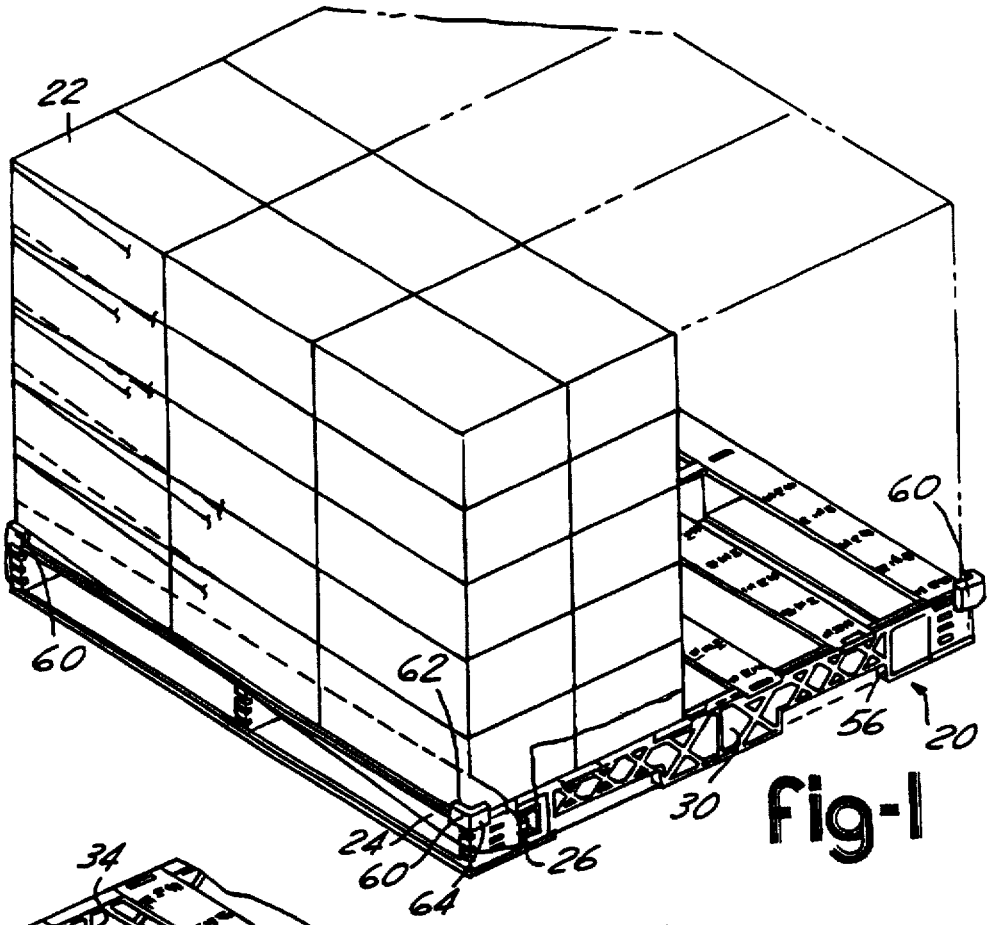
FIG. 1 is a perspective view, partially in cutaway, of a pallet made in accordance with the present invention, having objects or boxes stacked on top thereof, with a wrapping sheet of stretch film being spirally wrapped about the pallet and boxes.

In the preferred embodiment of the invention, a pallet 20 is shown in FIG. 1 with a large number of boxes or objects 22 secured to the pallet 20 by a plastic wrapping sheet of stretch film 24. An end 26 of wrapping sheet 24 is attached to the pallet 20 and is then wrapped in a spiral manner about the perimeter of the pallet 20 and the perimeter of the boxes or objects 22 stacked on top of pallet 20.

Figure 2:
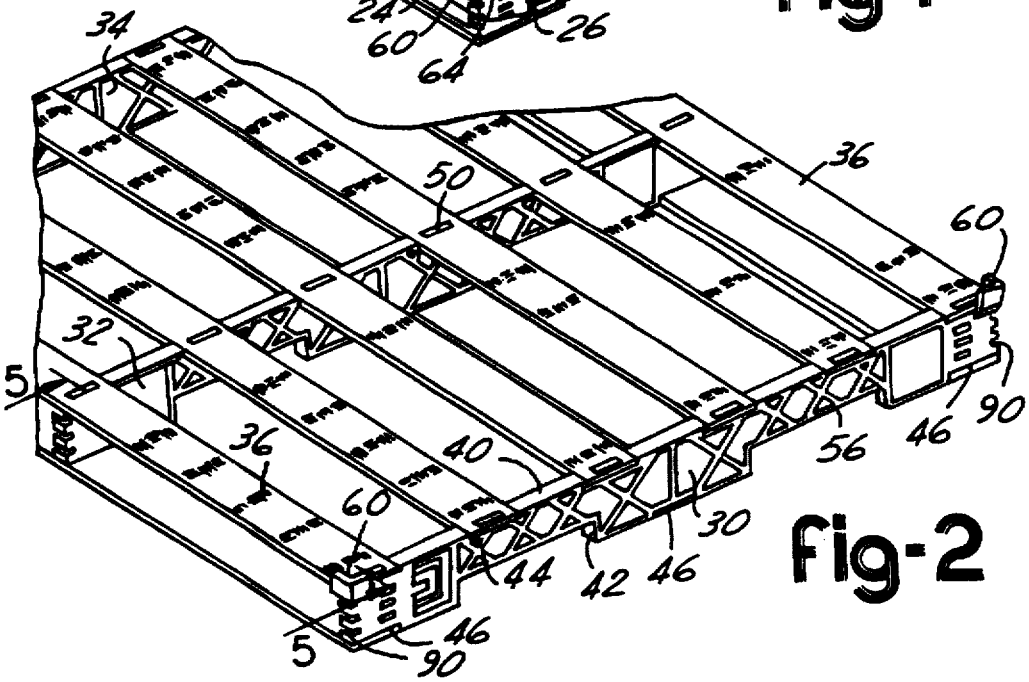
FIG. 2 is a fragmentary perspective view of the pallet.

FIG. 2 shows a fragmentary view of the pallet 20 without boxes 22. Pallet 20 comprises a plurality of longitudinally spaced and laterally extending elongate rails including front rail 30, an intermediate rail 32 and a back rail 34. Pallet 20 also has a plurality of laterally spaced and longitudinally extending elongate slats 36 which are secured to rails 30, 32 and 34. Rails 30, 32, and 34 are generally identically formed, except for differences which will be described below. Preferably, slats 36 are also identically formed with respect to one another.

Figure 15:
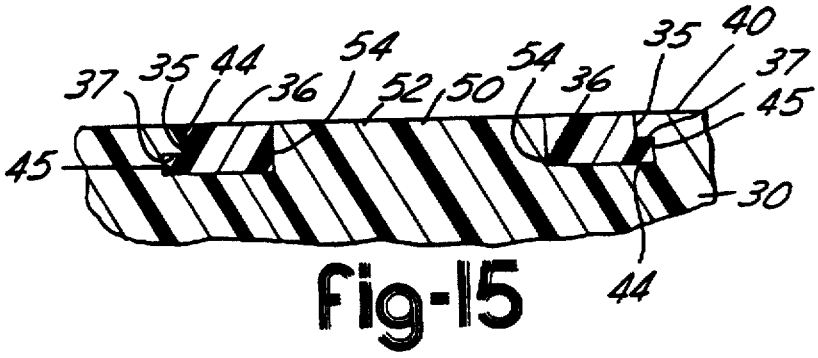
FIG. 15 is a sectional view taken along line 15—15 of FIG. 3.

Referring to FIGS. 2–4 and 15, rail 30 has a top surface 40 and a bottom surface 42. Formed in top surface 40 are a plurality of laterally spaced notches 44 which are sized and configured to snugly receive cross-sectional perimeter portions of slats 36 therein. As best seen in FIG. 15, slats 36 have steps 35 formed therein at locations corresponding to notches 46. Steps 35 define laterally outwardly extending flanges 37. Notches 44 have undercuts 45 adjacent their bottom surfaces. Flanges 37 of slats 36 are press-fit into undercuts 45 of recesses 44 thereby forming interlocking joints.

Likewise, bottom surface 42 has notches 46 for receiving slats 36. Rails 32 and 34 similarly retain slats 36 in notches 44 and 46. Slats 36 have top and bottom surfaces 38 and 39. Top and bottom notches 44 and 46 are designed to receive slats 36 therein such that top surfaces 38 of slats 36 and top surfaces 40 of rails 30, 32 and 34, as well as bottom surfaces 39 of slats 36 and bottom surfaces 42 of rails 30, 32, and 34 cooperate to form flush, planar top and bottom surfaces to pallet 20.

Figure 5:
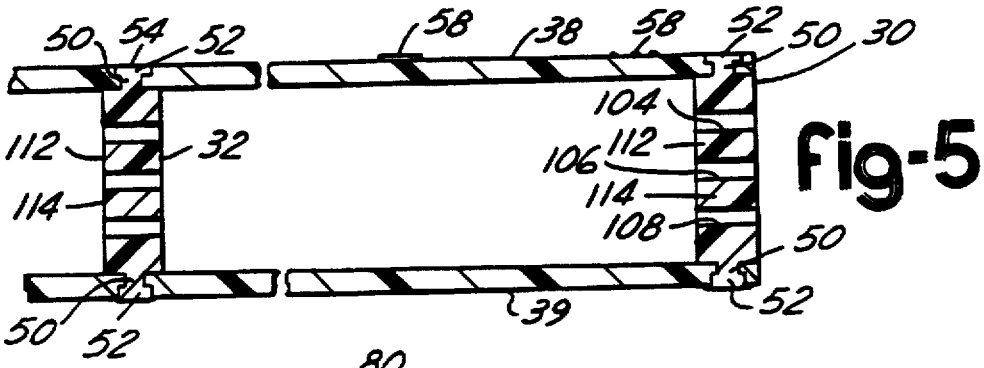
FIG. 5 is a fragmentary sectional view taken along line 5—5 of FIG. 2.
Figure 13:
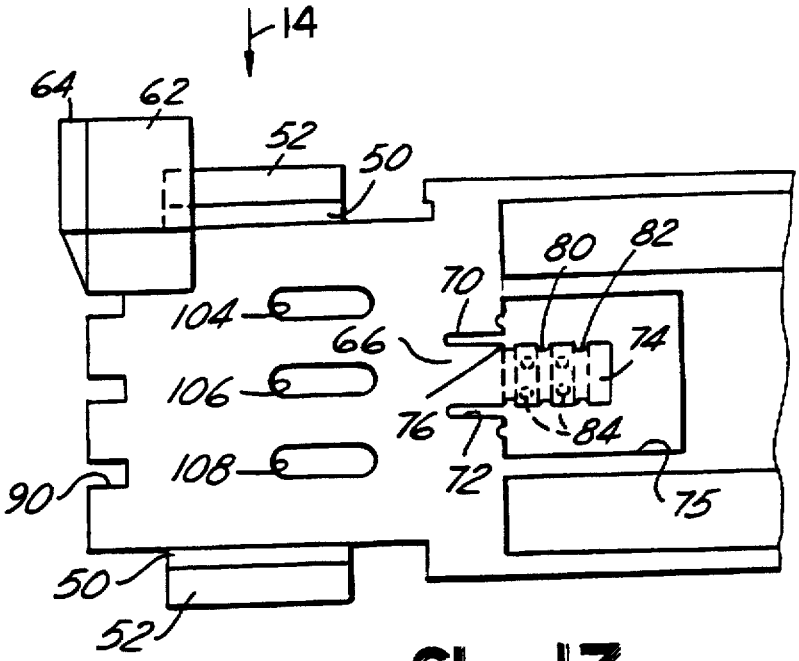
FIG. 13 is an enlarged fragmentary front view of a rail.
Figure 14:
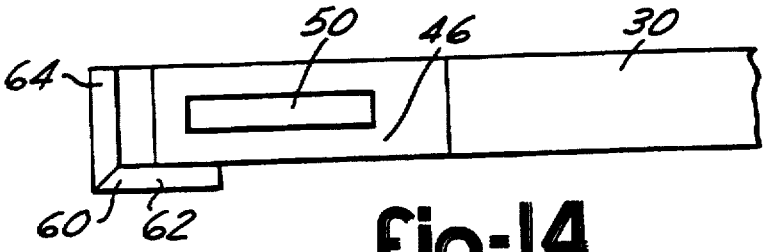
FIG. 14 is a top view taken along arrow 14 of FIG. 13.

Top and bottom surfaces 40 and 42 of rails 30, 32 and 34 further include stakes 50 which have enlarged heads 52, as best seen in FIGS. 5 and 13. Slats 36 have longitudinally spaced apertures 54 which are sized and configured to receive enlarged heads 52 in a press-fit manner. Once slats 36 are pressed over enlarged heads 52 of stakes 50, enlarged heads 52 and apertures 54 are then heat staked together. Note, that prior to heat-staking, stakes 50 extend vertically beyond top and bottom surfaces 38 and 39 of rail 30. After heat-staking, stakes 50 are flush with slats 36, as seen in FIG. 15. The combination of slats 36 being interlocked into respective top and bottom notches 44 and 46, apertures 54 being press-fit over stakes 50 and then being heat-staked together, results in pallet 20 being structurally stable and rigid.

This invention also includes using nails, preferably being made of a recyclable plastic, to nail slats 36 to rails 30 thereby constructing pallet 20. This would reduce or eliminate the need for press-fit or heat-stake interlocking joints to hold pallet 20 together.

Returning to FIG. 2, pallet 20 is adapted to receive forks of a fork lift in either a lateral or a longitudinal direction. Bottom surfaces 42 of rails 30, 32 and 34 have pairs of spaced openings 56 formed therein to receive the forks. In the lateral direction, the forks can be inserted into the regions between the upper and lower slats 36 on either longitudinal side of intermediate rail 32. Therefore, pallet 20 may be easily lifted and moved by a fork lift.

Figure 3:
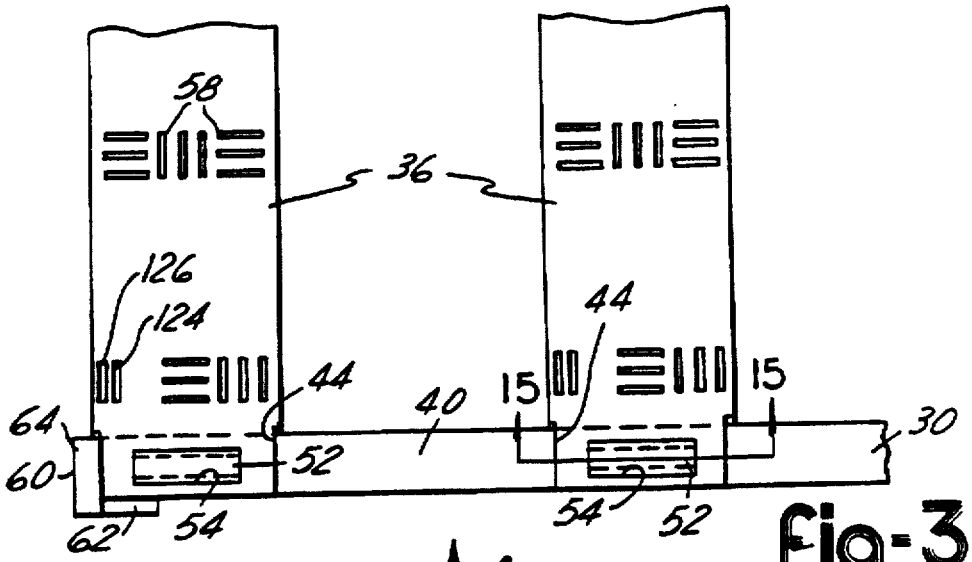
FIG. 3 is a fragmentary top view of a corner of the pallet.
Figure 4:
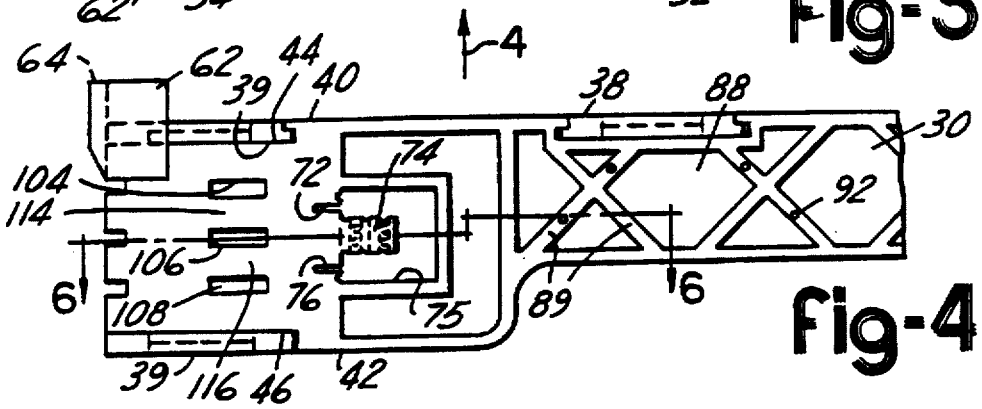
FIG. 4 is a fragmentary front view taken along arrow 4 of FIG. 3.

Slats 36 have vertically extending anti-skid ribs 58 located on their exterior surfaces, as seen in FIGS. 2 and 3. Ribs 58 are spaced along slats 36 and extend orthogonally with respect to one another in longitudinal and lateral directions thereby inhibiting movement of boxes or objects stacked atop pallet 20.

Corner supports 60 are provided at each of the ends of rails 30 and 34. Note that intermediate rail 32 does not have a corner support formed at its ends. Corner supports 60 have laterally and longitudinally extending flanges 62 and 64 extending vertically above the top surface 40 of rails 30 and 34. Flanges 62 and 64 are located outside top surfaces 40 and cooperate with another such that similar pallets 20 may be stacked one atop another. Further, corner supports 60 serve to retain boxes 22 from moving laterally or longitudinally upon pallet 20 when boxes 22 are wrapped together by wrapping sheet 24.

Figure 6:
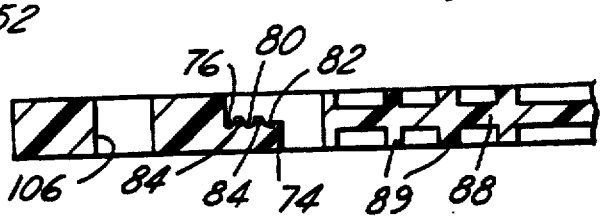
FIG. 6 a fragmentary sectional view taken along line 6—6 of FIG. 4.

FIGS. 4, 7–8 and 13 illustrate an anchoring means 66 to which end 26 of wrapping sheet 24 may be quickly attached and detached. Anchoring means 66 includes a pair of vertically spaced and laterally extending channels 70 and 72 and a laterally extending tongue 74. An opening 75 is formed about tongue 74 to provide easy access to tongue 74 and channels 70 and 72. Tongue 74, as seen in FIGS. 6 and 13, has three laterally spaced channels 76, 80 and 82 formed therein which extend around all but the front face of tongue 74. The back side of tongue 74 also has four spaced projections 84 extending rearwardly. Projections 84 are vertically and laterally spaced in pairs, with respect to one another, as shown in hidden lines in FIG. 13.

In operation, as seen in FIGS. 7 and 8, end 26 of wrapping sheet 24 is twisted until it becomes rope-like and is then wrapped about anchoring means 66. First, a portion of end 26 is wedgingly or frictionally received within upper channel 70. Wrapping sheet 24 may then extend about channels 76, 80 and 82 and projections 84. Next, wrapping sheet 24 is pulled into wedging reception within lower channel 72. Wrapping sheet 24 is then vertically spread as it is spirally wrapped about pallet 20 and boxes 22, as shown in FIG. 1.

FIG. 6 illustrates that rail 30 has a thinned web 88 and diagonal extending and criss-crossing braces 89. Thinned web 88 reduces the overall weight of pallet 20 while braces 89 maintain structural strength.

Pallet 20 has a couple of features to impede wrapping sheet 24 from climbing up boxes 22 and away from pallet 20. First, at each of the ends of rails 30, 32 and 34, are a plurality of vertically spaced corner grooves 90 which stretchably retain wrapping sheet 24 therein. See FIG. 7. Again, this prevents wrapping sheet 24 from moving upwardly away from grooves 90 of pallet 20.

Second, along the exterior or outwardly facing surfaces of rails 30 and 34, are located projections 92 extending outwardly from braces 89. As wrapping sheet 24 is stretchably wrapped about pallet 20, wrapping sheet 24 is stretchably retained about projections 92. Again, these projections 92 serve to anchor wrapping sheet 24 in place.

Alternative means for securing a large box or object 100 to pallet 20 is shown in FIGS. 9–12. In this case, a strap 102 is tightly wrapped about box 100 with strap 102 being retained in a self-locking manner to pallet 20. Strap 102 preferably has a surface with a fairly high coefficient of friction.

Looking to FIGS. 4–5 and 9–10, front rail 30 has three vertically spaced slots, namely, upper slot 104, middle slot 106 and lower slot 108 which form bars 112 and 114 therebetween. The end of strap 102 may be defined into three separate portions, an S-shaped leading portion 116 which extends through slots 104, 106 and 108 and wraps about bars 112 and 114, an intermediate portion 118 which extends rearwardly of bars 112 and 114, and a trailing portion 120 which extends through slot 104 and connects to the remainder of strap 102, which is wrapped about box 100.

When its desired to tighten strap 102, leading portion 116 of strap 102 is pulled causing strap 102 to tension about box 100 with trailing portion 120 moving rearwardly through slot 104, intermediate portion 118 moving downwardly toward slot 108, and leading portion 116 sliding about bars 112 and 114 with the free end of strap 102 moving away from pallet 20.

Conversely, when a pulling force is applied to trailing portion 120 in a direction away from leading portion 116, strap 102 will self-lock about pallet 20. As tension is applied to trailing portion 120, intermediate portion 118 tightens and compresses leading portion 116 against the back surface and back corners of bar 112. This frictional engagement of leading portion 116 between bar 112 and intermediate portion 118 is sufficient to prevent strap 102 from unlocking if sufficient tension is placed across strap 102. This self-locking of strap 102 eliminates the need for additional clips to fasten strap 102 to itself to maintain strap 102 wrapped about box 100.

Looking now to FIGS. 3 and 11–12, slats 36 have slots 124 and 126 formed therein which cooperate with strap 102 to self-lock strap 102 when box 100 is laterally secured by straps 102. Bars 128 and 130 are formed between slots 124, 126 and the lateral outboard edge of slat 36. In the manner just described above, leading portion 116 is frictionally retained against the lower surface and corners of bar 128 by intermediate portion 118 when sufficient tension is applied across strap 102 thereby self-locking strap 102 to slat 36.

This invention also includes a method of making a pallet 20 for retaining objects atop thereof. The method comprises first providing thermoplastic material. Preferably, pallet 20 is made from recycled thermoplastic materials such as polyethylene or polypropylene. This material may be obtained from recycling centers which grind up post-consumer waste products such as plastic beverages bottles. Also, old pallets may be recycled to produce pallet 20 described above.

Next, elongate rails 30, 32 and 34 and elongate slats 36 are molded. Slats 36 and rails 30, 32 and 34 are then connected to form a generally rectangular pallet. The pallet is preferably rigidly formed by way of mechanical interlocking joints as have been described above with respect to slats 36 and rails 32, 34 and 36. Optionally, heat-staking may also be used. The rails or slats may have any of the structural features formed therein which have been described above with respect to pallet 20.

While this invention has been described in the foregoing specification in relation to certain preferred embodiments thereof, and many details have been set forth for the purpose of illustration, it will be apparent to those skilled in the art that the invention is susceptible to additional embodiments and that certain details described herein can be varied considerably without departing from the basic principles of the invention.

What is claimed is:

1. A pallet which may rest upon a floor and upon which objects may be stacked and to which a wrapping sheet can be attached to wrap about objects on the pallet, the pallet comprising:

a first member having a first surface upon which the objects may be stacked;

a second member having a second surface spaced from the first surface and adapted to rest upon a floor; and an intermediate portion connecting the first and second members and defining a laterally extending periphery oriented substantially vertically between the first and second surfaces, the intermediate portion having at least one horizontally disposed retaining channel for restraining a wrapping sheet from upward movement, the channel having a pair of opposed walls spaced to receive and wedgingly entrap a wrapping sheet therebetween;

wherein the wrapping sheet can be frictionally retained within the retaining channel to anchor the wrapping sheet so that the sheet may be wrapped about the pallet in a generally horizontal plane and so that the sheet may be wrapped upon, and thereby securing, itself and the load without lifting the pallet and the objects from the floor.

2. The pallet of claim 1 wherein:

the retaining channel extends laterally in a first direction so as provide opposition to a wrapping sheet held therein and the wrapping sheet may extend in an opposite peripheral direction to spirally wrap about the periphery of the pallet and the objects stacked thereatop.

3. The pallet of claim 1 wherein:

the intermediate portion defines a rectangular periphery having a corner portion with at least one laterally extending and outwardly opening groove formed therein so that the wrapping sheet may be stretchably secured within the groove thereby impeding the wrapping sheet from moving toward the first surface when wrapped about the pallet.

4. The pallet of claim 1 further comprising:

elongate rails and slats, the rails forming the intermediate portion and the slats forming the first and second members.

5. A pallet which rests upon a floor and upon which objects may be stacked and to which a wrapping sheet can be attached to wrap about objects on the pallet, the pallet comprising:

a first member having a first generally planar surface upon which the objects may be stacked;

a second member having a second surface spaced from the first surface and adapted to rest upon a floor; and an intermediate portion connecting the first and second members and defining a laterally extending periphery oriented substantially vertically, the intermediate portion having a corner portion including at least one laterally extending and outwardly opening groove into which at least a portion of the wrapping sheet may pass in a generally horizontal plane and so that the sheet may be wrapped upon, and thereby securing, itself and the load without lifting the pallet and the objects from the floor.

6. The pallet of claim 5 wherein:

the corner portion has a plurality of parallel and laterally extending grooves into which at least a portion of the wrapping sheet may pass to prevent the sheet from sliding toward the first surface.

7. A pallet which may rest upon a floor and upon which objects may be stacked and to which a strap may be attached to wrap about the objects, the pallet comprising:

a first member having a first surface upon which the objects may be stacked;

a second member having a second surface spaced from the first surface and adapted to rest upon a floor; and an intermediate portion connecting the first and second members and defining a laterally extending periphery oriented substantially vertically;

wherein at least one of the first member, the second member, or the intermediate portion has two spaced apart bars defining a slot therebetween and having two strap surfaces which are positioned outboard relative to the slot, the two bars defining the intermediate slot being spaced sufficiently close to the slot so that a portion of the strap may be threaded about the two outboard strap surfaces and through the slot in an S-shaped fashion with another portion of the strap frictionally capturing the S-shaped portion against the pallet when the strap is placed under tension such that the strap is self-locking and does not require a separate-fastener to secure the strap to the pallet.

8. The pallet of claim 7 wherein:

the two bars defining the intermediate slot and the outboard strap surfaces are formed in the intermediate portion.

9. The pallet of claim 7 wherein:

the two bars defining the intermediate slot and the outboard surfaces are formed in the first member.

10. The pallet of claim 7 wherein:

the pallet includes a plurality of spaced apart and parallel extending slats defining the first surface, the two bars which define the intermediate slot and the outboard strap surfaces, being formed in one of the slats.

11. A pallet which may rest upon a floor and upon which objects may be stacked, the pallet comprising:

a first member having a first generally planar surface upon which the objects may be stacked;

a second member having a second surface spaced from the first surface and adapted to rest upon a floor;

an intermediate portion connecting the first and second members and defining a laterally extending periphery oriented substantially vertically between the first and second surfaces, the intermediate portion having a wrapping sheet retaining channel, the channel having a pair of opposed walls sufficiently closely spaced together to receive and wedgingly entrap a wrapping sheet therebetween; and a wrapping sheet wedgingly retained within the retaining channel so that the sheet may be tautly wrapped in a generally horizontal direction about the pallet and the objects to retain the objects on the pallet.

12. The pallet of claim 11 wherein:

the retaining channel extends laterally in a first direction with the wrapping sheet held therein and the wrapping sheet extending in a second opposing direction so that the wrapping sheet may be spirally wrapped about the periphery of the pallet and the objects stacked thereatop.

13. The pallet of claim 11 further comprising:

elongate rails and slats, the rails forming the intermediate portion and the slats forming the first and second members.

14. The pallet of claim 11 wherein:

the intermediate portion defines a rectangular periphery having a corner portion with at least one laterally extending and outwardly opening groove formed therein with the wrapping sheet stretchably secured within the groove thereby impeding the wrapping sheet from moving toward the first surface.

15. A pallet which rests upon a floor and upon which objects may be stacked, the pallet comprising:

a first member having a first generally planar surface upon which the objects may be stacked;

a second member having a second surface spaced from the first surface and adapted to rest upon a floor;

an intermediate portion connecting the first and second members and defining a laterally extending periphery, the intermediate portion having a corner portion including at least one horizontally extending and outwardly opening groove; and a wrapping sheet passing horizontally through the groove to prevent the sheet from sliding upwardly towards the first surface.

16. The pallet of claim 15 wherein:

the intermediate portion defines a rectangular periphery.

* * * * *